US006102049A

United States Patent [19]

Chang

[11] Patent Number: 6,102,049

[45] **Date of Patent: *Aug. 15, 2000**

[54] HAIR HOLDING DEVICE

[76] Inventor: Wen Hsiung Chang, No. 7, Alley 116, Lane 175, Sec. 1, Tatung Rd., Tainan City, Taiwan

[ * ] Notice: This patent is subject to a terminal disclaimer.

[21] Appl. No.: 09/411,304

[22] Filed: Oct. 4, 1999

[51] Int. Cl.[7] ..... A45D 8/04; A45D 8/40; A45D 8/12

[52] U.S. Cl. ..... 132/273; 132/274; 132/275

[58] Field of Search ..... 132/273, 274, 132/275, 212, 54; 63/5.1

[56] References Cited

U.S. PATENT DOCUMENTS 5,692,243 12/1997 Chang ..... 132/273
5,890,497 4/1999 Tsai ..... 132/273
5,913,319 6/1999 Tsai ..... 132/247
5,937,872 8/1999 Wang ..... 132/273

*Primary Examiner*—John J. Wilson
*Assistant Examiner*—Robyn K Doan
*Attorney, Agent, or Firm*—Charles E. Baxley

[57] ABSTRACT

A hair holding device includes a number of first plates and a corresponding number of second plates arranged in an annular manner. Each first plate is engaged with three second plates, and each second plate engages with three first plates. At least one of the second plates includes an extension formed on a lateral side thereof, the extension having an engaging member formed thereon. At least one of the first plates includes a slot for releasably engaging with the engaging member and allowing the engaging member to slide in the slot.

4 Claims, 6 Drawing Sheets

HAIR HOLDING DEVICE

BACKGROUND OF THE INVENTION

1. Field of the Invention

The present invention relates to a hair holding device for hairs of different amount.

2. Description of the Related Art

FIG. 7 of the drawings illustrates a typical hair holder that includes a plurality of first plates 1' and a corresponding number of second plates 2'. Each first plate 1' includes three pegs 11' formed on a side thereof, while each second plate 2' includes three holes 21'. Each first plate 1' engages with three adjacent second plates 2', while each second plate 2' engages with three adjacent first plates 1'. The first plates 1' and the second plates 2' together form a cone and define a space 3' in a center thereof for receiving the hair of a user, as shown in FIG. 8. When in use, the user may expand the hair holder to make the space 3' larger for receiving her hair, and the hair holder is then collapsed to reduce the space 3' and thus holds the hair, as shown in FIG. 9. However, the engaging effect between the peg 11' and the hole 21' is not satisfactory such that disengagement between the first plate 1' and the second plate 2' often occurs when the space 3' is made larger during outward expansion of the hair holder. Applicant's U.S. patent application Ser. No. 09/249,592 filed on Feb. 16, 1999 discloses an improved hair holding device to solve above problems. The present invention is intended to provide a different design in this regard.

SUMMARY OF THE INVENTION

It is a primary object of the present invention to provide a hair holding device comprising a plurality of first plates and a corresponding number of second plates of the type mentioned above.

At least one of the second plates includes an extension formed on a lateral side thereof, the extension having an engaging member formed thereon. At least one of the first plates includes a slot for releasably engaging with the engaging member and allowing the engaging member to slide in the slot, thereby providing increased hair holding effect and allowing the hair holding device to be adjusted to hold hairs of different amount. In an alternative design of the invention, at least one of the first plates includes an extension formed on a lateral side thereof, the extension having an engaging member formed thereon. At least one of the second plates includes a slot for releasably engaging with the engaging member.

Each second plate may further include a plurality of pin-like protrusions on an inner side thereof. The protrusions may stick into the hair of the user to provide a more reliable hair holding effect.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
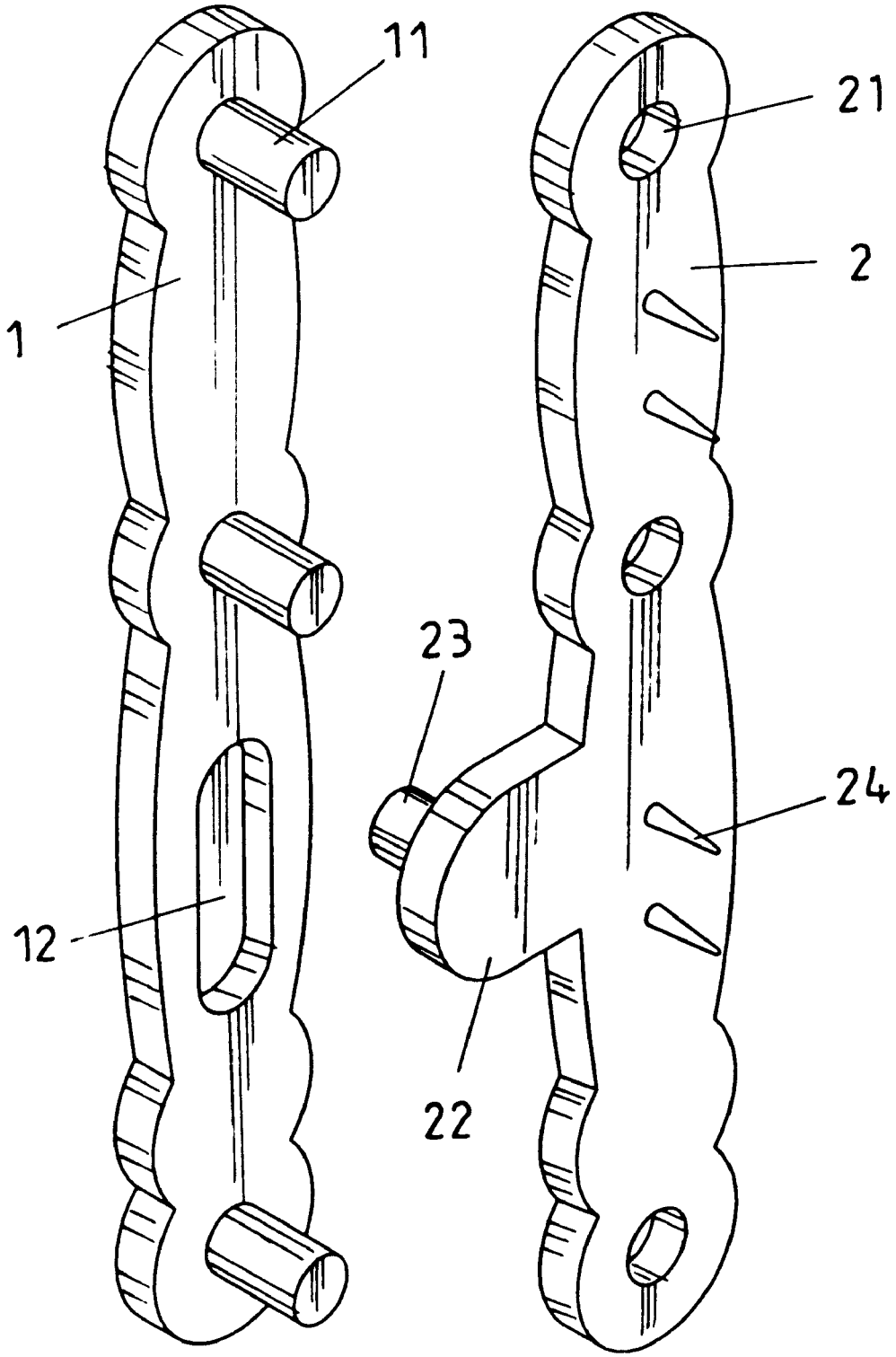
FIG. 1 is a perspective view illustrating a first plate and a second plate of a hair holding device in accordance with the present invention.
Figure 2:
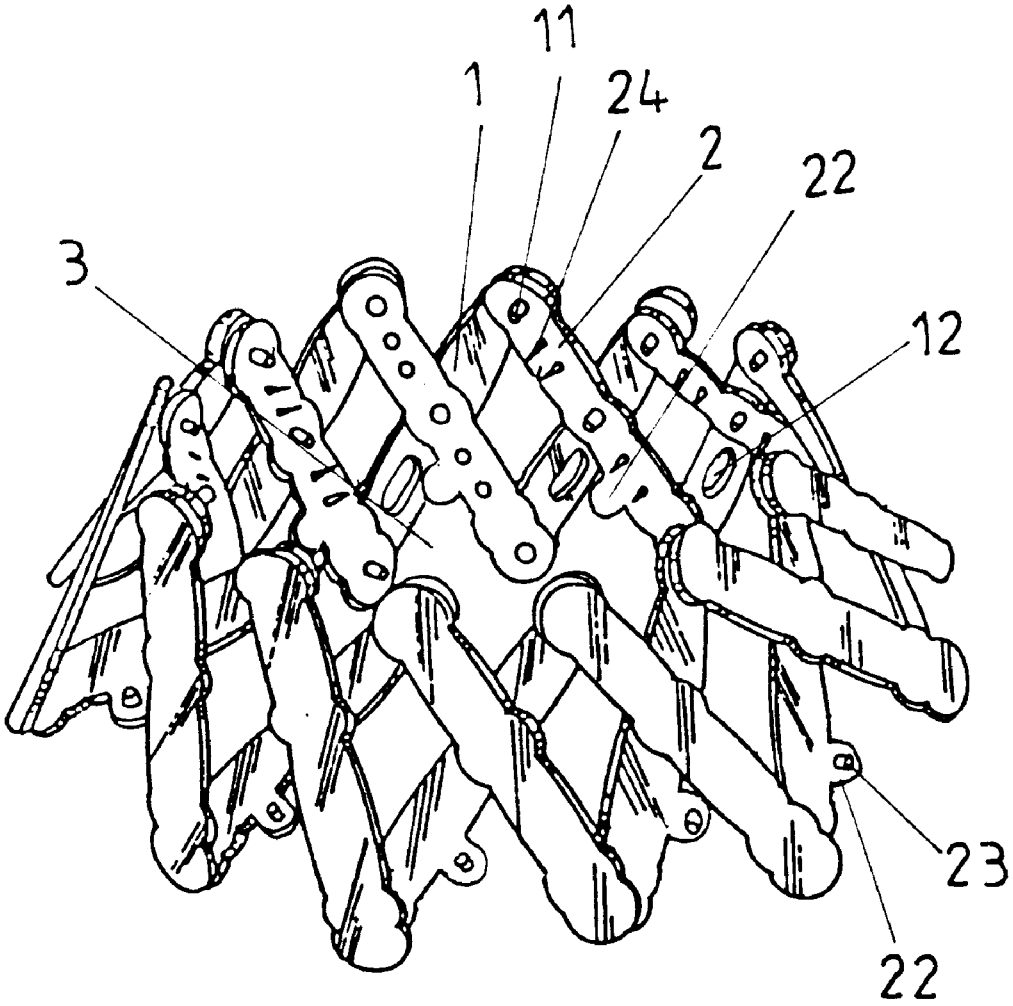
FIG. 2 is a perspective view of the hair holding device in accordance with the present invention.

Referring to FIGS. 1 to 6 and initially to FIG. 2, a hair holding device in accordance with the present invention generally includes a plurality of first plates 1 and a corresponding number of second plates 2 arranged in an annular manner. Each first plate 1 includes three pegs 11 while each second plate 2 includes three holes 21, as shown in FIG. 1. Each first plate 1 engages with three adjacent second plates 2. As can be seen from FIG. 2, for each first plate 1 and the three second plates 2 engaged therewith, the uppermost peg 11 of the first plate 1 engages with an uppermost hole 21 of the leftmost second plate 2, the middle peg 11 of the first plate 1 engages with the middle hole 21 of the middle second plate 2, and the lowermost peg 11 of the first plate 1 engages with the lowermost hole 21 of the rightmost second plate 2. Each second plate 2 also engages with three adjacent first plates 1. As can be seen from FIG. 2, for each second plate 2 and the three first plates 1 engaged therewith, the uppermost hole 21 of the second plate 2 engages with the uppermost peg 11 of the rightmost first plate 1, the middle hole 21 of the second plate 2 engages with the middle peg 11 of the middle first plate 1, and the lowermost hole 21 of the second plate 2 engages with the lowermost peg 11 of the leftmost first plate 1.

As can be seen from FIG. 1, at least one of the second plates 2 includes an extension 22 formed on a lateral side thereof, an engaging member 23 being formed on the extension 22. At least one of the first plates 1 includes a groove or slot 12 for releasably engaging with the engaging member 23 on an associated second plate 2 and allowing the engaging member 23 to slide in the slot 12.

Figure 3:
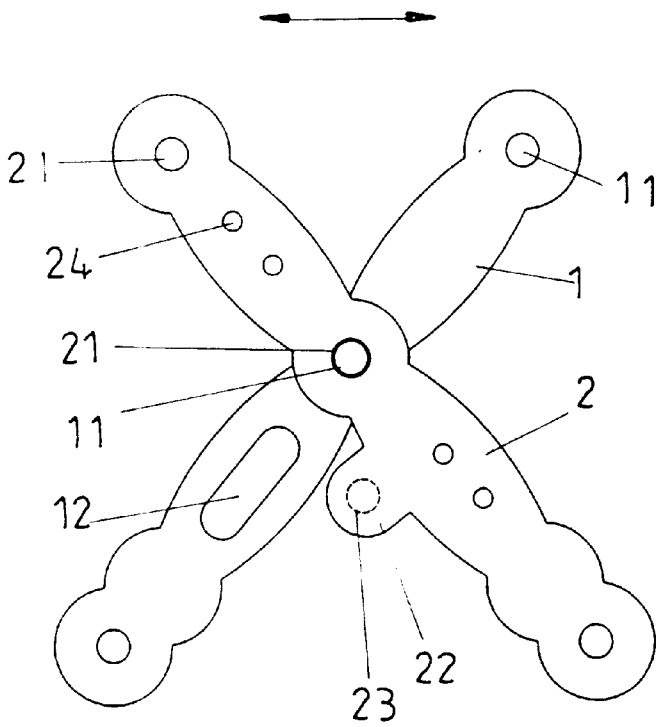
FIG. 3 is an enlarged view illustrating engagement between the first plate and the second plate when the hair holding device is in an expanded status.
Figure 4:
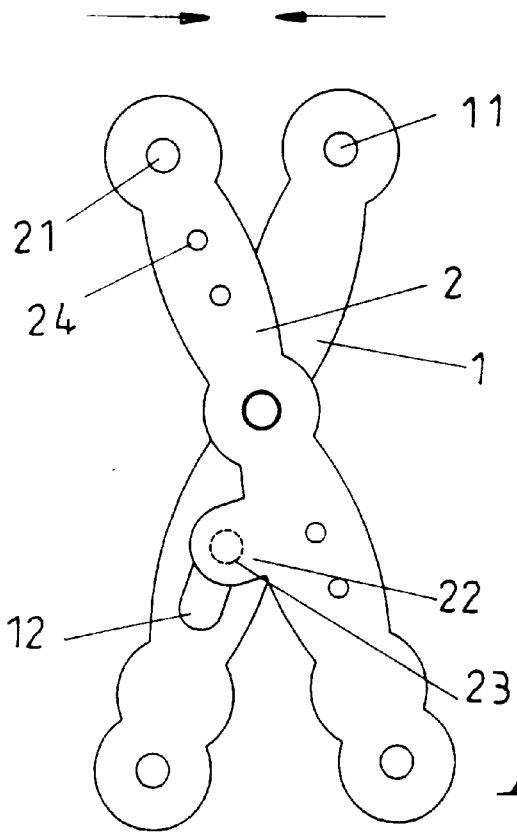
FIG. 4 is a side view illustrating engagement between the first plate and the second plate when the hair holding device is in a collapsed status.
Figure 5:
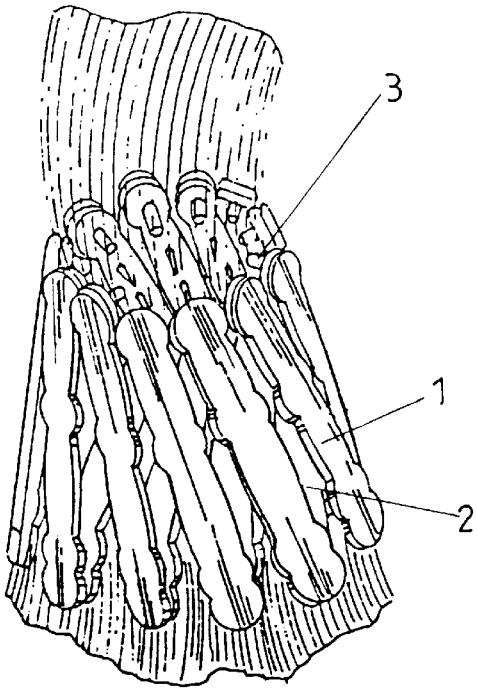
FIG. 5 is a schematic view illustrating a use of the hair holding device in accordance with the present invention.
Figure 6:
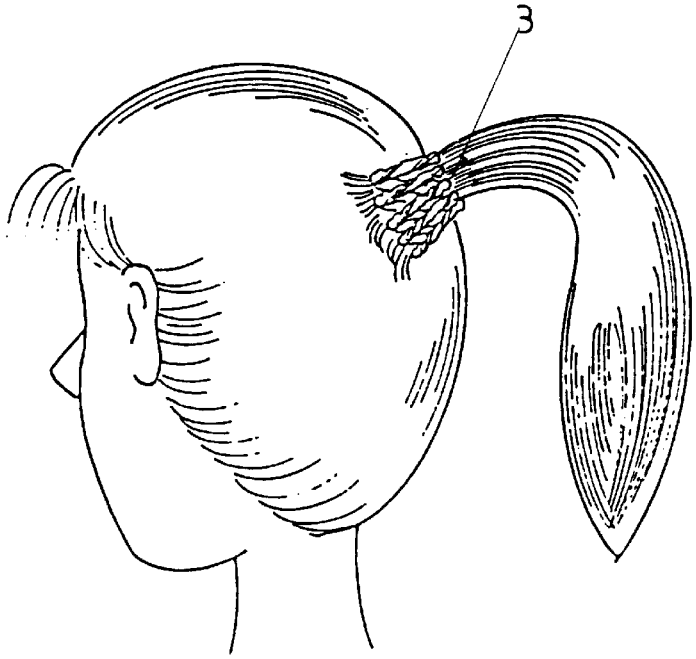
FIG. 6 is a schematic view illustrating another use of the hair holding device in accordance with the present invention.

Referring to FIGS. 3 and 4, the engaging member 23 of a second plate 2 may be releasably engaged with the slot 12 of an associated adjacent first plate 1. As illustrated, the first plate 1 and the second plate 2 in FIG. 4 are more close to each other than those in FIG. 3 for holding hair. Referring to FIG. 5, the hair holding device includes a space 3 in a center thereof that is defined by the first plates 1 and the second plates 2. It is appreciated that the engaging member 23 is slidable in the slot 12 to allow adjustment of the space for holding hairs of different amount. FIG. 6 illustrates another use of the hair holding device. Removal of the hair holding device is simple after disengaging the engaging member 23 from the slot 12 and expanding the hair holding device.

Referring to FIG. 1, each second plate 2 may include a plurality of pin-like projections 24 on an inner side thereof. The protrusions 24 may stick into the hair of the user to provide a more reliable hair holding effect.

Figure 7:
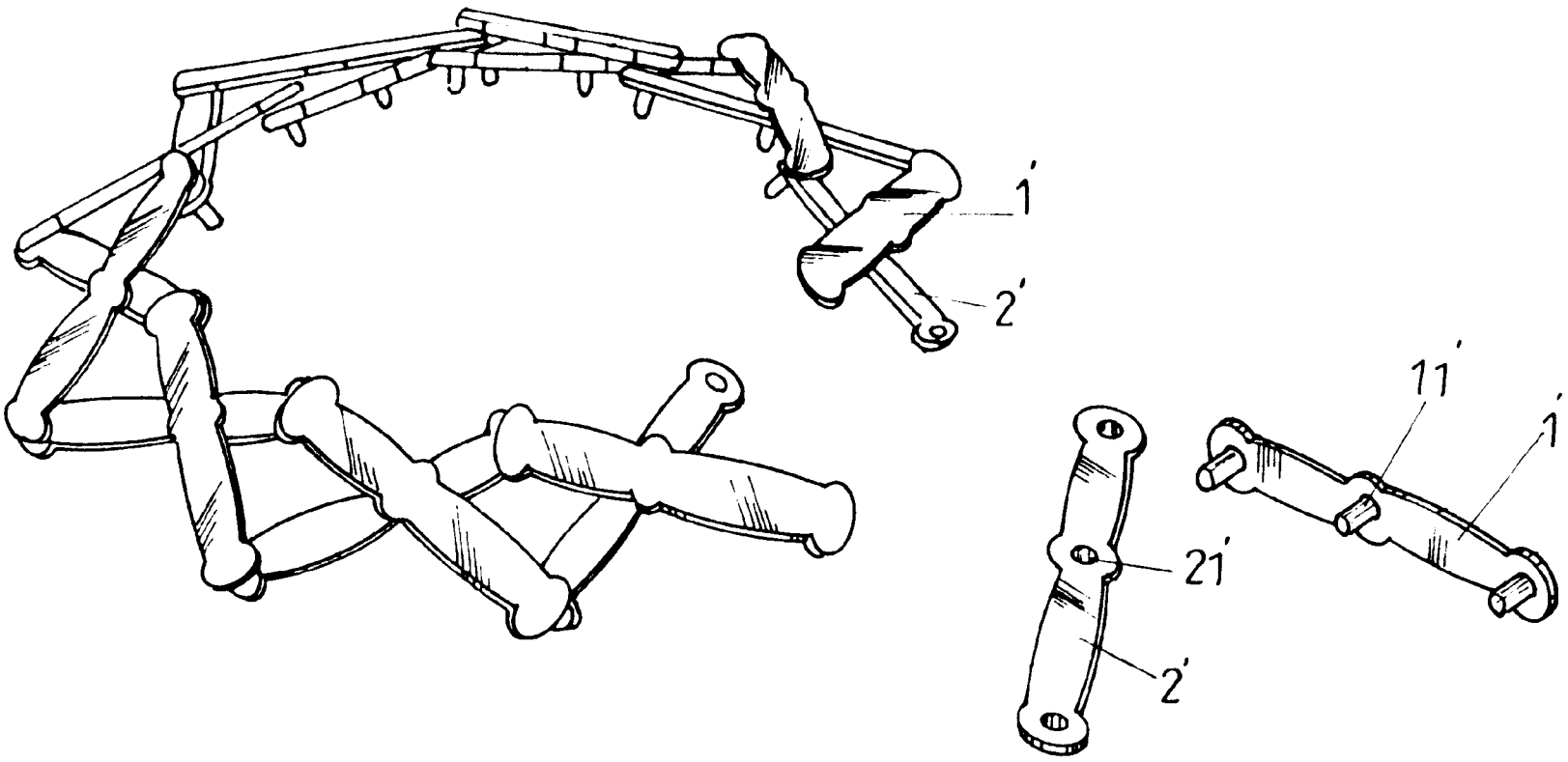
FIG. 7 PRIOR ART
FIG. 7 is a perspective view, partly exploded, of a conventional hair holder.
Figure 8:
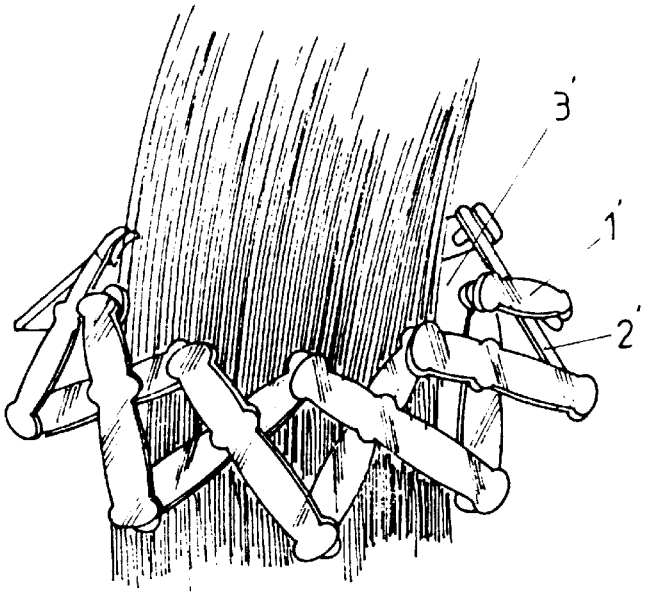
FIG. 8 PRIOR ART
FIG. 8 is a schematic view illustrating a first step of use of the hair holding device in FIG. 7.
Figure 9:
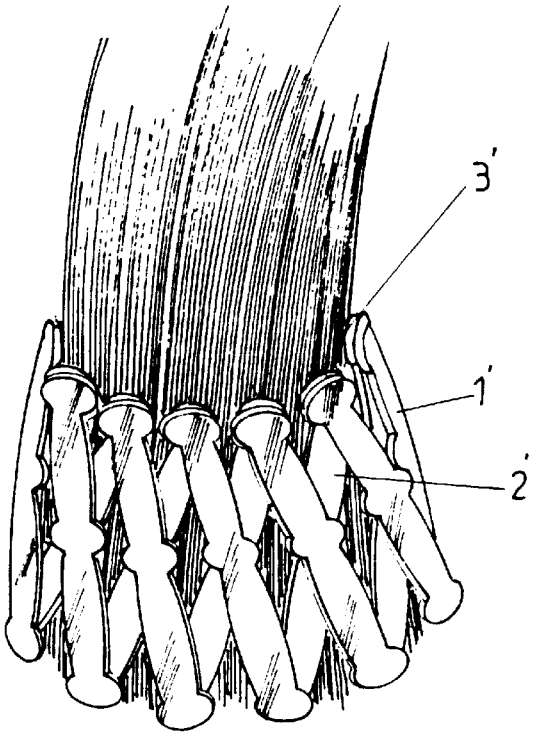
FIG. 9 PRIOR ART
FIG. 9 is a schematic view illustrating a hair held by the hair holding device in FIG. 7.

It is not necessary to have all of the second plates 2 equipped with the engaging member 23 and have all of the first plates 2 equipped with the slot 12. A hair holding device in accordance with the present invention may incorporate some conventional first and second plates 1' and 2' shown in FIG. 7. In addition, the extension 22 with the engaging member 23 may be formed on the first plate 1 instead of the second plate 2, and the slot 12 may be defined in the second plate 2 instead of the first plate 1.

Although the invention has been explained in relation to its preferred embodiment, it is to be understood that many other possible modifications and variations can be made without departing from the spirit and scope of the invention as hereinafter claimed.

What is claimed is:

1. A hair holding device comprising a plurality of first plates and a corresponding number of second plates arranged in an annular manner, each said first plate including three pegs, each said second plate including three holes, each said first plate engaging with three adjacent said second plates, each said second plate engaging with three adjacent said first plates, the improvements comprising:

at least one of said second plates including an extension formed on a lateral side thereof, the extension having an engaging member formed thereon, at least one of the first plates including a slot for releasably engaging with the engaging member and allowing the engaging member to slide in the slot.

2. The hair holding device as claimed in claim 1, wherein the second plate includes a plurality of protrusions that stick into the hair of the user to provide increased hair holding effect.

3. A hair holding device comprising a plurality of first plates and a corresponding number of second plates arranged in an annular manner, each said first plate including three pegs, each said second plate including three holes, each said first plate engaging with three adjacent said second plates, each said second plate engaging with three adjacent said first plates, the improvements comprising:

at least one of said first plates including an extension formed on a lateral side thereof, the extension having an engaging member formed thereon, at least one of the second plates including a slot for releasably engaging with the engaging member and allowing the engaging member to slide in the slot.

4. The hair holding device as claimed in claim 3, wherein the second plate includes a plurality of protrusions that stick into the hair of the user to provide increased hair holding effect.

* * * * *